US006648798B2

(12) United States Patent
Yoo

(10) Patent No.: US 6,648,798 B2
(45) Date of Patent: Nov. 18, 2003

(54) CONCENTRIC CONTROL SYSTEM FOR EXERCISE APPARATUSES AND METHOD THEREOF

(75) Inventor: Jae-Won Yoo, Seoul (KR)

(73) Assignee: Sewoo System Co., Ltd., Seoul (KR)

( * ) Notice: Subject to any disclaimer, the term of this patent is extended or adjusted under 35 U.S.C. 154(b) by 219 days.

(21) Appl. No.: 09/955,107

(22) Filed: Sep. 19, 2001

(65) Prior Publication Data

US 2002/0042328 A1 Apr. 11, 2002

Related U.S. Application Data

(63) Continuation-in-part of application No. 09/576,434, filed on May 22, 2000, now abandoned.

(30) Foreign Application Priority Data

May 2, 2000 (KR) ..... 2000-23432

(51) Int. Cl.[7] ..... A63B 21/00
(52) U.S. Cl. ..... 482/8; 482/1; 434/247
(58) Field of Search ..... 482/1–9, 51, 54, 482/57, 900–902; 434/247; 600/520

(56) References Cited

U.S. PATENT DOCUMENTS 6,050,924 A 4/2000 Shea
6,053,844 A 4/2000 Clem
6,458,060 B1 * 10/2002 Watterson et al. ..... 482/54
6,461,162 B1 * 10/2002 Reitman et al. ..... 434/247

* cited by examiner

*Primary Examiner*—Glenn E. Richman
(74) *Attorney, Agent, or Firm*—Robert E. Bushnell, Esq.

(57) ABSTRACT

Disclosed is a concentric control system for exercise apparatuses and a method thereof, and more particularly, to a concentric control system and method for exercise apparatuses that is capable of inputting data relevant to user's exercise and based upon the exercise quantity taken by the user, controlling the exercise apparatuses. The concentric control system includes an exercise program storing unit in which an exercise program is stored in order to designate an adequate quantity of exercise at a time when a user uses a predetermined exercise apparatus, a comparing unit for receiving the exercise quantity of the user measured from the predetermined exercise apparatus during the exercise and comparing the received data with data on the exercise quantity of the user designated by the exercise program and a central processing unit for outputting a control signal controlling the electronic controllers of the exercise apparatuses, based upon the comparing result of the comparing unit.

20 Claims, 7 Drawing Sheets

CONCENTRIC CONTROL SYSTEM FOR EXERCISE APPARATUSES AND METHOD THEREOF

CROSS-REFERENCE TO RELATED APPLICATIONS

This application is a continuation-in-part of Applicant's Ser. No. 09/576,434 filed in the U.S. Patent & Trademark Office on May 22, 2000, now abandoned, and assigned to the assignee of the present application, makes reference thereto, incorporates the same herein, and claims all benefits accruing therefrom under 35 U.S.C. §120.

CLAIM OF PRIORITY

This application makes reference to, incorporates the same herein, and claims all benefits accruing under 35 U.S.C. §119 from my application entitled METHOD FOR CONTROL OF HEALTH IMPROVE MACHINE USING INTERNET AND SYSTEM USING THE SAME filed with the Korean Industrial Property Office on May 2, 2000 and there duly assigned Serial No. 2000-23432.

BACKGROUND OF THE INVENTION

1. Field of the Invention

The present invention relates to a concentric control system for exercise apparatuses and a method thereof, and more particularly, to a concentric control system and method for exercise apparatuses that is capable of inputting data relevant to user's exercise and based upon the exercise quantity taken by the user, controlling the exercise apparatuses.

2. Background of the Related Art

As the people die at an old age, recently, they become very interested in taking care of their health, regardless of sex or age. Generally, many people see their doctors in order to detect the diseases they may be taken early enough or to protect them at previous stages. In addition, they try to be in good health conditions at non-medical centers such as sports clubs. Such an approach often occurs at home or at health clubs. On the other hand, various kinds of exercise apparatuses such as, for example, running machines, steppers, indoor bicycles and so on are widely used for the purpose of supporting the user's health management.

To operate such the exercise apparatuses, however, first the data relevant to user's exercise is inputted and the exercise pattern to be desired by the user is then inputted. That is, the user who desires to use a predetermined exercise apparatus should input his or her weight and height and then input his or her desired exercise time and strength. Once he and she inputs the data relevant to his or her exercise to the corresponding exercise apparatus, the exercise apparatus operates based upon the data characteristics inputted, irrespective of his or her exercise capability and condition. Therefore, the user fails to have a substantially exercise effect.

Moreover, if the user inputs the data relevant to his or her exercise directly to the exercise apparatus, he or she should input the data every time the exercise apparatus to be used. This causes a considerable inconvenience in inputting the data, thereby making the use chances of the exercise apparatuses really lost. In addition, in case where the user takes exercise at several places, it is impossible to manage his or her exercise with any system.

SUMMARY OF THE INVENTION

It is therefore an object of the present invention to provide an improved computerized exercise system.

It is also an object of the present invention to formulate custom made exercises based on user's age, weight, sex, exercise history, blood pressure, height, and other medical conditions that the user may have.

It is further an object of the present invention to provide a computerized exercise system controlled through the internet allowing the user to exercise at any location and still receive the benefits of custom made exercises where the difficulty, intensity, length of time are controlled based on a stored exercise history of a user.

It is yet another object of the present invention to provide a computer controlled exercise system that continually monitors the user's heart rate and compares the user's heart rate during the duration of an exercise (in-situ) with a target heart rate and adjusts in situ the difficulty and intensity of the exercise as a user's heart rate deviates from the target heart rate at any point in time during the exercise.

It is yet further an object of the present invention to provide custom made exercises for a plurality of exercise equipment for a user based on the user's goals and objectives (i.e., whether the user is a beginner exerciser, whether the user exercises just to reduce weight, whether the user wants to improve physical strength, or whether the user is training for a competition).

It is still also an object of the present invention to provide custom programs for a particular piece of exercise equipment for a user based on results and history of exercise on other exercise equipment.

It is still yet another object of the present invention is to provide a concentric control system for exercise apparatuses and a method thereof that if a user inputs data relevant to exercise to a predetermined exercise apparatus, operates based upon the characteristics of the data inputted, monitors his or her exercise quantity and if it is determined that his or her exercise quantity is somewhat small, controls in real time the predetermined exercise apparatus such that the exercise apparatus operates in such a manner to increase the user's exercise quantity, but if it is determined that the exercise quantity is somewhat large, controls in real time the predetermined exercise apparatus such that the exercise apparatus operates in such a manner to decrease the user's exercise quantity.

It is still another object of the present invention to provide a concentric control system for exercise apparatuses and a method thereof that when there are arranged the exercise apparatuses at a predetermined place, controls all of the exercise apparatuses by the input at a time of the data relevant to user's exercise thereto.

It is yet another object of the present invention to provide a concentric control system for exercise apparatuses and a method thereof that inputs the data relevant to the exercise of a user for the exercise apparatuses to a central management server through a leased line, a public line network, an Internet network and so on and controls the exercise apparatuses of the user, based upon the exercise quantity of the user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

According to a first aspect of the present invention, there is provided a concentric control system for a plurality of exercise apparatuses that concentrically manages and controls the plurality of exercise apparatuses each having an electronic controller therein, includes: an exercise program storing unit in which an exercise program is stored in order to designate an adequate quantity of exercise at a time when a user uses a predetermined exercise apparatus; a comparing unit for receiving the exercise quantity of the user measured from the predetermined exercise apparatus during the exercise and comparing the received data with data on the exercise quantity of the user designated by the exercise program; and a central processing unit for outputting, if the exercise quantity of the user measured during the exercise is substantially smaller than that designated by the exercise program, a control signal such that the electronic controller of the predetermined exercise apparatus operates in order to increase the user's exercise quantity and for outputting, if the exercise quantity of the user measured during the exercise is substantially larger than that designated by the exercise program, another control signal such that the electronic controller of the predetermined exercise apparatus operates in order to decrease the user's exercise quantity. Desirably, the exercise quantity of the user for the predetermined exercise apparatus is measured in proportional relation with the heart rate of the user.

It is desirable that the central processing unit outputs video data, such that the exercise quantity designated by the exercise program and the exercise quantity of the user measured during the exercise simultaneously display on the predetermined exercise apparatus. Furthermore, the concentric control device further includes an exercise program processor which receives data relevant to exercise inputted by the user and based upon the input data, produces the exercise program adequate to the user. Desirably, the concentric control device according to the present invention is connected with the plurality of exercise apparatuses through a mutual communication network. Preferably, the communication network is Internet or LAN.

According to a second aspect of the present invention, there is provided a concentric control method in which a concentric control system is connected with at least one or more exercise apparatuses each having an electronic controller therein through a mutual communication network for the purpose of controlling at least one or more exercise apparatuses, the control method including the steps of recognizing information on a user and a predetermined exercise apparatus used by the user when the user uses the predetermined exercise apparatus, extracting exercise quantity of the user designated from an exercise program previously stored that corresponds with the recognized information on the user and the predetermined exercise apparatus and comparing the extracted exercise quantity of the user with the exercise quantity of the user measured and transmitted from the predetermined exercise apparatus during exercise and, if the exercise quantity of the user measured during the exercise is substantially smaller than that designated by the exercise program, outputting a control signal such that the electronic controller of the predetermined exercise apparatus operates in order to increase the user's exercise quantity and if the exercise quantity of the user measured during the exercise is substantially larger than that designated by the exercise program, outputting another control signal such that the electronic controller of the predetermined exercise apparatus operates in order to decrease the user's exercise quantity.

Hereinafter, preferred embodiments of the present invention is in detail described with reference to the accompanying drawings, in which like numbers indicate the same or similar elements. In addition, while the present invention is described with reference to a few specific components, the description is illustrative of the invention and is not to be construed as limiting the invention. Various modifications may occur to those skilled in the art without departing from the true spirit and scope of the invention. On the other hand, an explanation on the functions and methods that are well known to those skilled in the art will be excluded in this detailed description for the sake of brevity.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
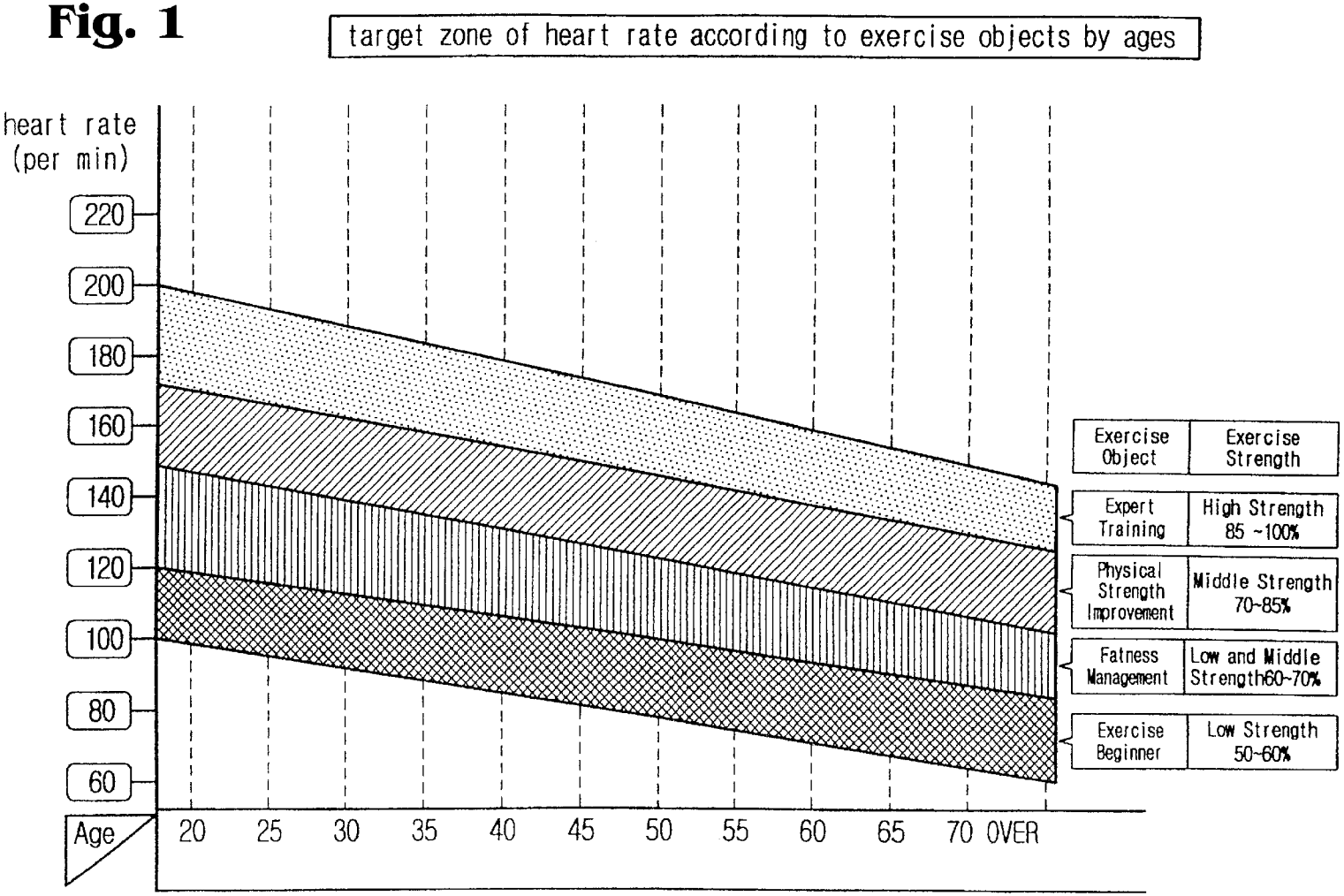
FIG. 1 is a graph for a target heart rate zone according to exercise objects by ages, which is applied in a concentric control system for exercise apparatuses according to the present invention.

Turning to the figures, FIG. 1 is a graph for a target heart rate zone according to exercise objectives of a user for different ages, which is applied in a concentric control system for exercise apparatuses according to the present invention. If you exercise, your heart beat rate (hereinafter, referred to as heart rate) is increased. The more your exercise quantity increases, the higher your heart rate becomes. Therefore, the index of the exercise quantity (or intensity) during the exercise can be estimated in proportional relation with the heart rate.

As shown in FIG. 1, ages are indicated on a horizontal axes and heart rates per minute are indicated on a vertical axes. In this case, the exercise strength even for the same age is varied according to objectives of a user (e.g., beginner exerciser, weight management, physical strength improvement and expert competitive training) of the exercise and therefore, target zone is divided into the different kinds of exercise strength. At this time, the target zone is formed by a minimum heart rate and a maximum heart rate obtained according to the exercise objects at a predetermined age. For example, in case of a beginner who is 60 years old, he or she should exercise at a relatively low strength in a range of the heart rate from 80 times per minute to 100 times per minute.

However, if he or she exercises at relatively low or intermediate strength in order to control his or her fatness, he or she should exercise in a range of the heart rate from 100 times per minute to 120 times per minute. The target zone is first formed according to the exercise objects and the ages, which is obtained by a regression equation based upon the extraction of various samples. Of course, various modifications may be assumed on the condition where special variants such as user's diseases or particular exercise records are considered.

Figure 2:
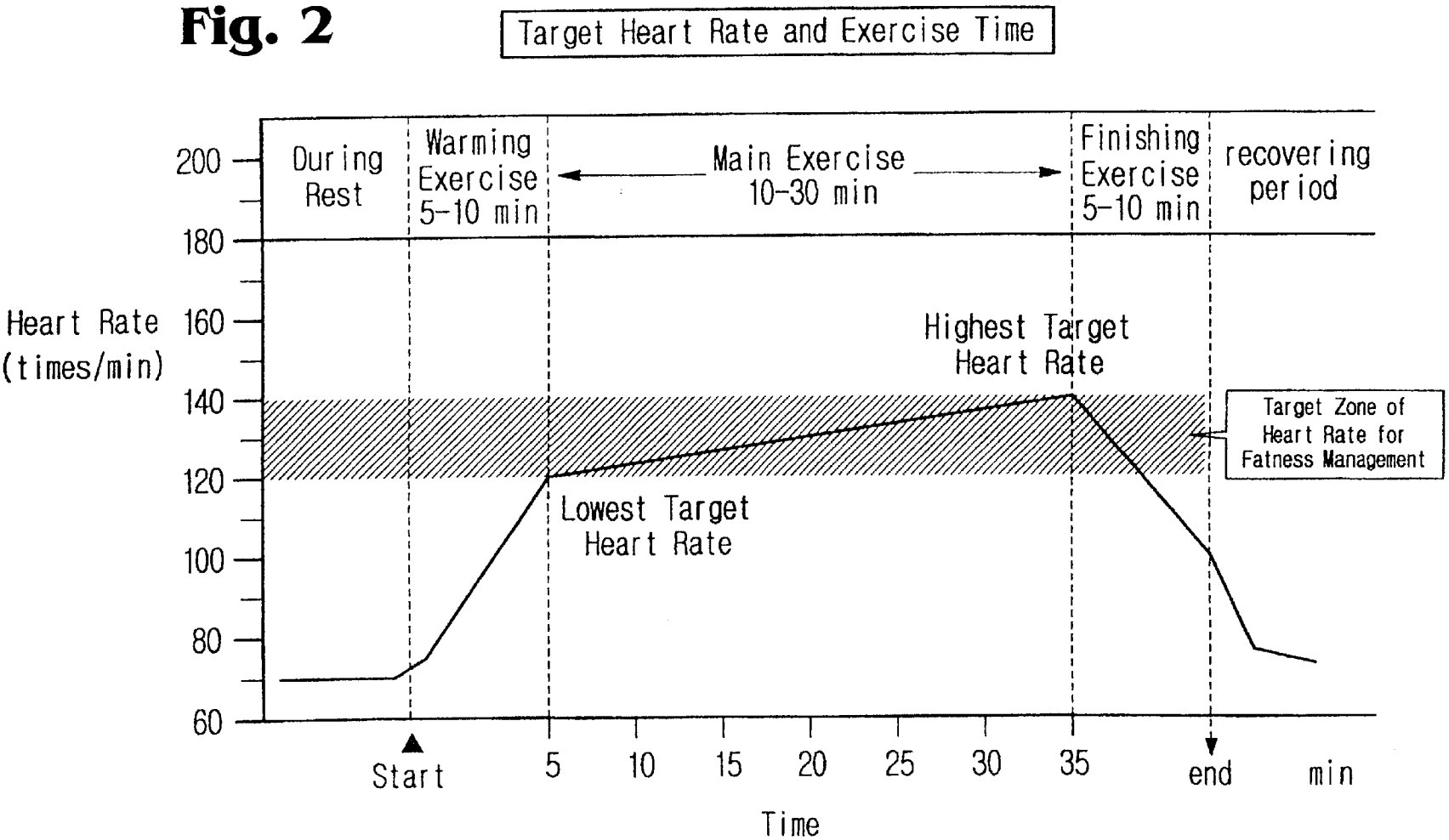
FIG. 2 is a graph for a target heart rate according to exercise time, which is applied in a concentric control system for exercise apparatuses according to the present invention.

FIG. 2 is a graph for a target heart rate according to exercise time, which is applied in a concentric control system for exercise apparatuses according to the present invention. The exercise using the exercise apparatus is generally divided into a warming stage, a real (or main) exercise stage and a finishing stage. The exercise strength and time are dependent upon the kinds of the exercise apparatus, the exercise objects and the ages. Therefore, the exercise program as shown in FIG. 2 is formalized by a specialist, based upon the state of the user using the exercise apparatus and his or her exercise object. In addition, if the user inputs his or her age and exercise object, based upon the graph for the target heart rate zone according to the exercise objects by ages as shown in FIG. 1, the exercise program as shown in FIG. 2 can be formalized by an exercise program processor that builds the exercise program for each of the exercise apparatuses.

Referring to FIG. 2, the exercise program is provided to a user who is 20 years old and wishes to control his or her fatness. According to the exercise program, the user exercises at the warming stage for 5 minutes to 10 minutes until he or she reaches the minimum heart rate of 120 of the exercise target zone of a person of 20 years old age, at the real exercise stage for 10 minutes to 35 minutes until he or she reaches the maximum heart rate of 140 and at the finishing stage for 5 minutes to 10 minutes.

Figure 3:
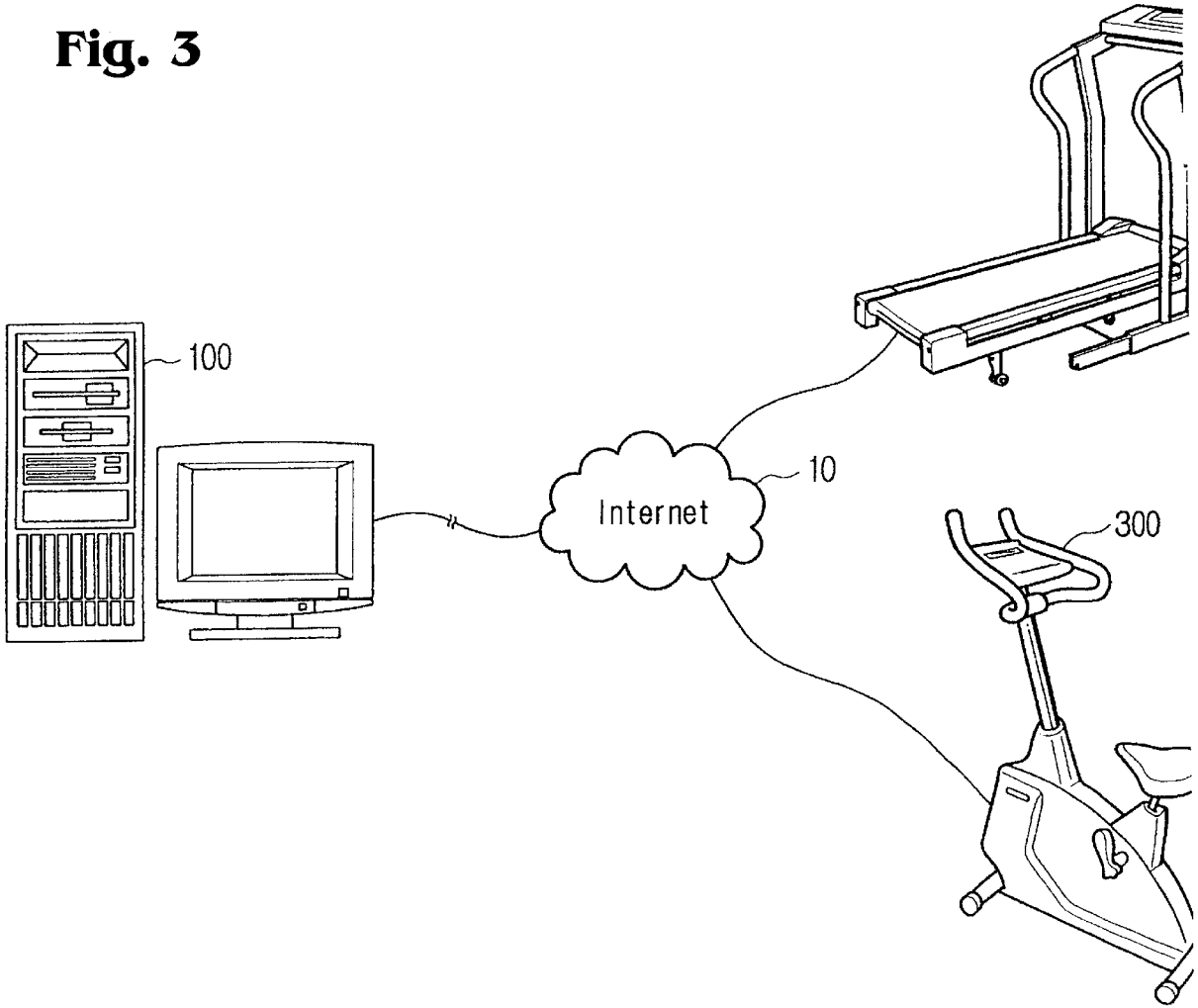
FIG. 3 is an exemplary view illustrating the concentric control system according to the present invention that is connected to the exercise apparatuses.

FIG. 3 is an exemplary view illustrating the concentric control system according to the present invention that is connected to the exercise apparatuses. Referring to FIG. 3, all kinds of electronically controlled exercise apparatuses, for example, a running machine 200 and a cycle 300 are connected via a communication network 10 to the concentric control system according to the present invention. In this case, the communication network 10 includes all communication networks, for example, a public switched telephone network (PSTN), an integrated services digital network (ISDN), a local area network (LAN) and a wide area network (WAN), on which data transmission is carried out between the exercise apparatuses and the concentric control system. The data transmission between the concentric control system and the terminals of the exercise apparatuses is freely carried out through web browser over the Internet.

Figure 4:
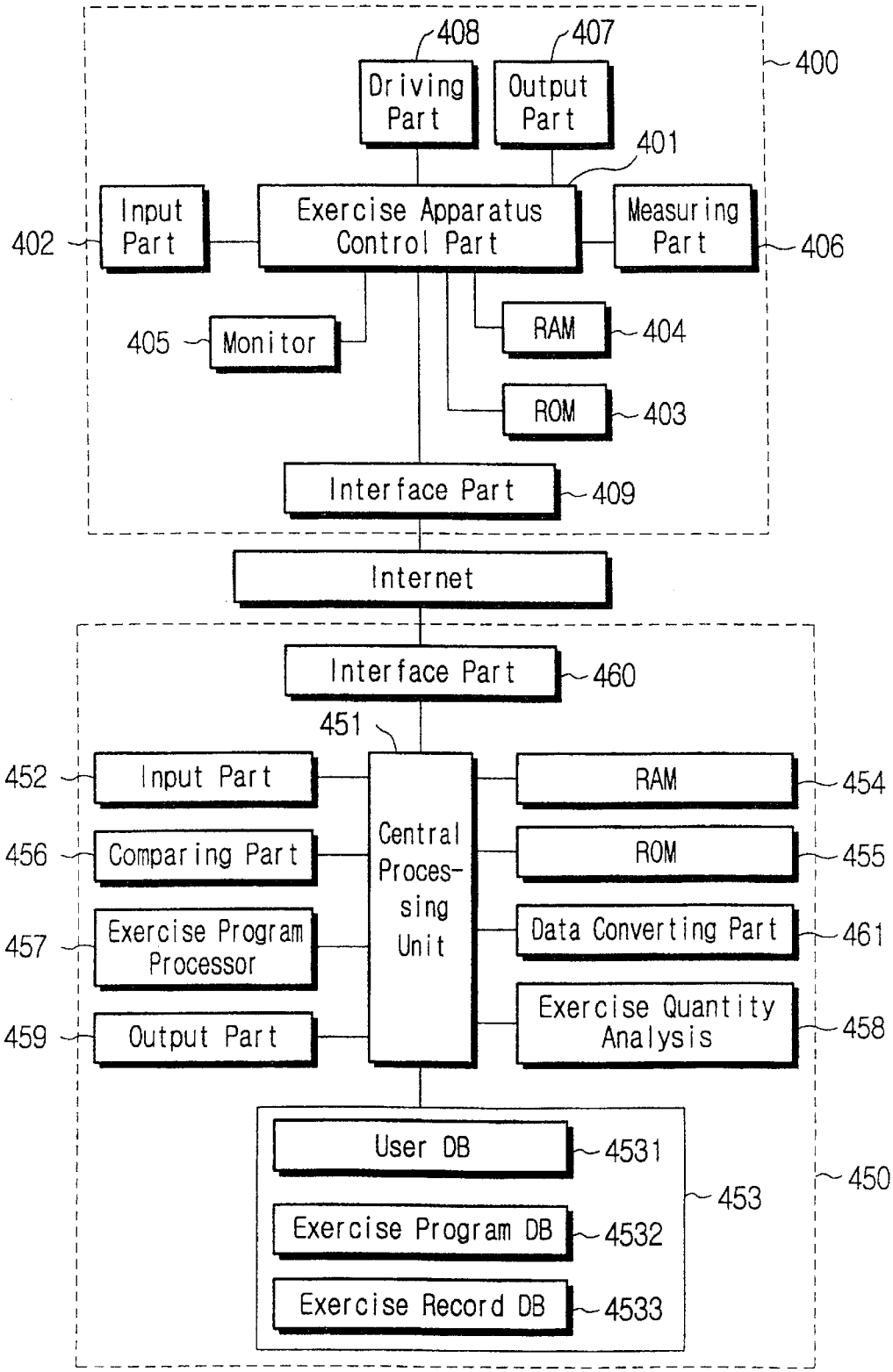
FIG. 4 is a block diagram illustrating the configurations of the concentric control system according to the present invention and each of the exercise apparatuses.

FIG. 4 is a block diagram illustrating the configurations of the concentric control system according to the present invention and each of the exercise apparatuses. The exercise apparatus, which includes an electronic controller, is designated by a reference numeral 400. The exercise apparatus 400 operates by the connection with the concentric control system 450 according to the present invention through the Internet, but can operate independently. The exercise apparatus 400 is comprised of an exercise apparatus control part 401 for processing all kinds of data, an input part 402 for data input, an ROM 403 for storing data and program, a RAM 404 for temporarily storing data, a monitor 405 for visually displaying data, a measuring part 406 for measuring a real heart rate of the user during exercise, an output part 407 like a kind of printer, a driving part 408 for changing variable facts such as displacement, torque and r.p.m. (revolution per minute), level of incline on a running machine, physical resistance in the case of a cycle machine, and an interface 409 for data conversion such that the data transmission and reception are carried out between the Internet and the exercise apparatus control part 401.

Under the above construction, the exercise apparatus is provided with the input part 402 having a selection button for determining whether the exercise apparatus operates with the concentric control system 450 according to the present invention. The input part 402 further includes buttons for inputting data relevant to the exercise of the user such as the ID and password, the height, the weight, the age, the specific medical record, and the exercise object (or goals) of the user. In addition, the ROM 403 stores another exercise program that is provided when the exercise apparatus 400 operates independently of the concentric control system 450 according to the present invention.

The concentric control system 450 according to the present invention is comprised of a central processing unit 451 for processing data and logical operations, an input part 452 like a keyboard, a mouse and so on, a data base part 453 for storing all kinds of data, an RAM 454 for temporarily storing data and an ROM 455 for storing application program and preserved data.

The data base (DB) part 453 includes a user DB 4531 where data on the name, the ID, the password, the past medical record and the exercise object of the user is stored, an exercise program DB 4532 where the exercise program adequate to a predetermined exercise apparatus to be used by the user is stored and an exercise record DB 4533 where the exercise quantity of the user for each of the exercise apparatuses used or the total exercise quantity of the user in the unit of day, week or month is stored. The concentric control system 450 according to the present invention further includes a comparing part 456, an exercise program processor 457, an exercise quantity analyzing processor 458, a data converting part 461, an output part 459 and an interface 460. At this time, when the user uses the predetermined exercise apparatus 400 the comparing part 456 reads appropriate heart rate (hereinafter, reference heart rate) of the user from the exercise program DB 4532 under a control of the central processing unit 451 and compares the read reference heart rate with the real heart rate of the user measured from the measuring part 406.

On the other hand, the exercise program processor 457 produces the exercise program of the user adequate to the predetermined exercise apparatus 400, based upon the data relevant to the exercise of the user stored in the user DB 4531 and the target heart rate zone according to the exercise objects by ages as shown in FIG. 1 and stores the exercise program in the exercise program DB 4532 under the control of the central processing unit 451. Instead of the exercise program processor 457, at this time, the specialists may artificially formalize the exercise program, based upon the data stored in the user DB 4531 and input it in the exercise program DB 4533.

The exercise quantity analyzing processor 458 calculates the exercise quantity of the user of the predetermined exercise apparatus 400 and the exercise quantity of the same user of another exercise apparatus connected through the Internet network, calculates them in the units of day, week and month, and stores the calculated data in the exercise record DB 4533, under the control of the central processing unit 451.

The data converting part 461 converts the data such that the data on the heart rate of the user measured in the measuring part 406 is displayed as a predetermined graph on the monitor 405 and the data on the reference heart rate read from the exercise program DB 4532 is displayed as a predetermined graph on the monitor 405.

Figure 5:
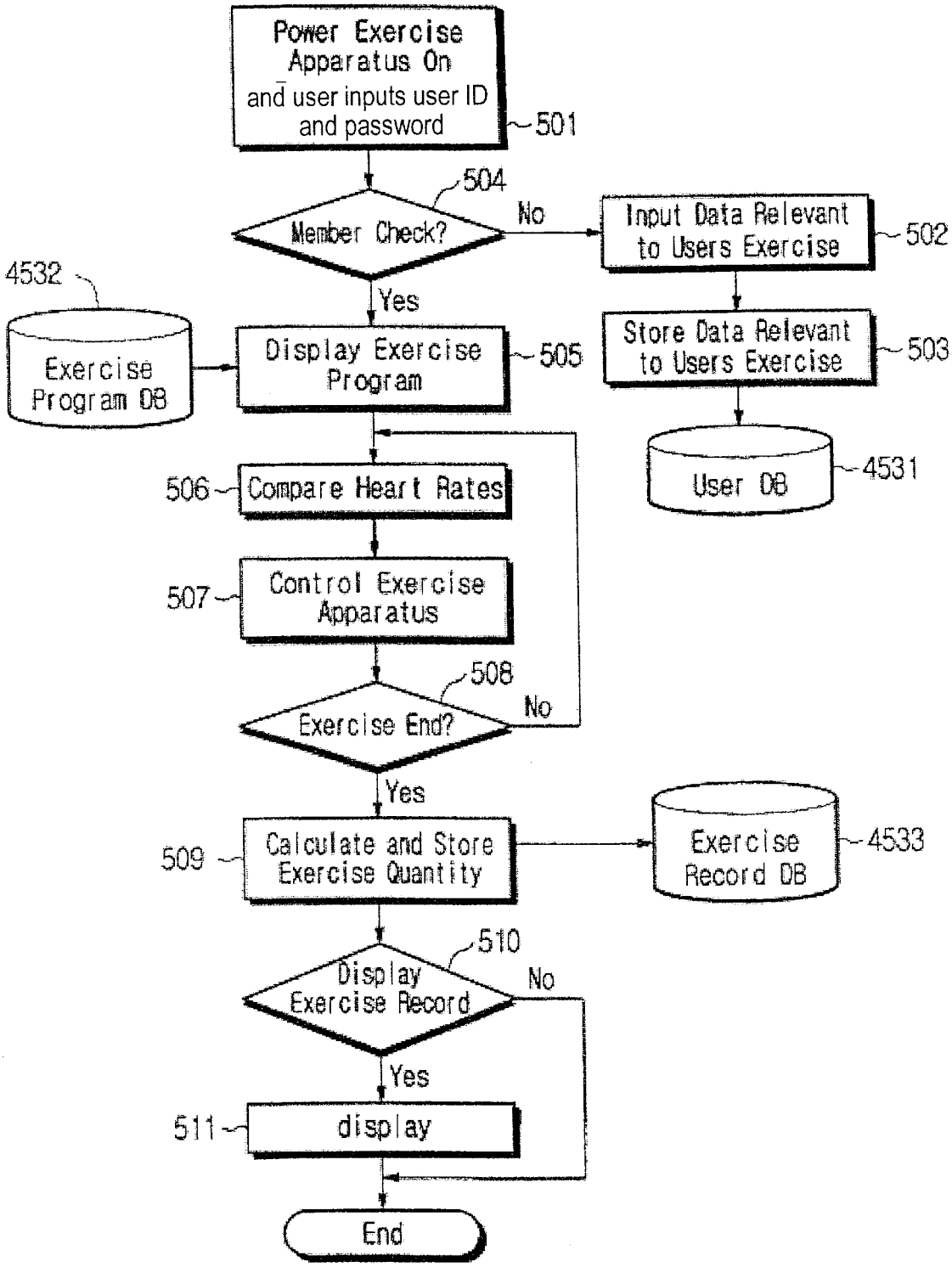
FIG. 5 is a flowchart illustrating a method for controlling each of the exercise apparatuses connected through Internet with the concentric control system according to the present invention, using the concentric control system.

Hereinafter, an explanation of a method for controlling the exercise apparatus connected through the Internet with the concentric control system according to the present invention, by using the concentric control system, will be described with reference to FIG. 5. First, the user powers the predetermined exercise apparatus (at step 501) and inputs the user's record and the user ID and password on the window of the web browser provided on the monitor 405 of the exercise apparatus 400 on the concentric control system 450 of the present invention (at step 502). The data on the exercise of the user is stored in the user DB 4531 in the concentric control system 450 (at step 503). The input of the data on the exercise of the user is carried out through the input part 452 in the concentric control system 450 or carried out through both the input part 452 and the input part 402 of the predetermined exercise apparatus 400. In this preferred embodiment of the present invention, the input of the data on the exercise of the user is carried out through the input part 402 of the predetermined exercise apparatus 400.

When the user's record and the user ID and password have been previously stored in the user DB 4531, it is checked whether the data on the user ID and password corresponds to that stored in the user DB 4531 in the concentric control system 450 in order to identify whether the user is legal (at step 504). If it is checked that the user is legal, the data processed in the data converting part 461 according to the data stored in the exercise program DB 4532 is transmitted and then displayed on the monitor 405 of the predetermined exercise apparatus 400 (at step 505). At this time, the graph for the reference heart rate, as shown in FIG. 2 is displayed. In this case, the control signal for the exercise apparatus as obtained on the basis of the heart rate is supplied from the concentric control system 450 to the exercise apparatus control part 401. Then, the exercise apparatus control part 401 controls and drives each of the driving parts 408.

The user exercises as the exercise apparatus 400 is driven, and during the exercise, the heart rate of the user measured by heart rate measuring means is inputted to the measuring part 406 and thus compared with that stored in the exercise program DB 4532 by means of the comparing part 456 of the concentric control system 450. At this time, the heart rate of the user measured in the measuring part 406 is processed in the data converting part 461 and displayed on the monitor 405. As a result, the heart rate of the user measured in the measuring part 406 is overlapped with the reference heart rate, as shown in FIG. 2.

Figure 6:
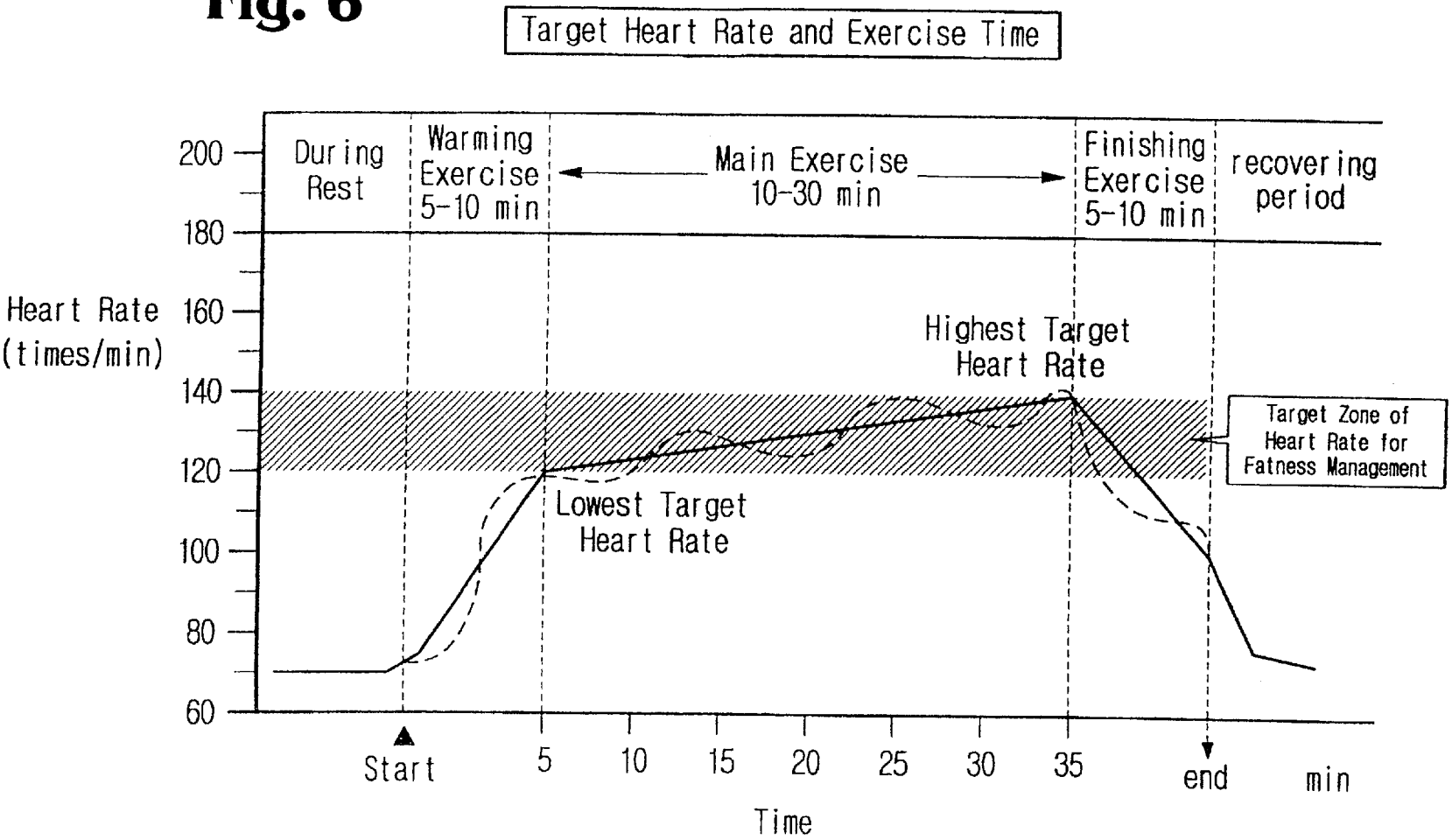
FIG. 6 is a graph for the overlapped heart rates.

FIG. 6 illustrates what is displayed on monitor 405 of exercise apparatus 400 during the course of an exercise. FIG. 6 is a graph for the overlapped heart rate, wherein the reference heart rate is illustrated as a solid line and the real heart rate of the user using the exercise apparatus as a dotted line. The reference or target heart rate is based on information input by a user into input part 402 before a user becomes registered and is given a user name. This information includes the age, height, weight, gender, blood pressure and objectives (beginner, fatness management, physical strength improvement, expert or competitive training). When the comparing result obtained by the comparing unit 456 is transmitted to the central processing unit 451, the central processing unit 451 transmits the control signal based upon the compared value to the exercise apparatus control part 401 of the exercise apparatus 400 (at step 506). At this time, if the real heart rate is substantially lower than the reference heart rate, the control signal controls the driving part 408, such that the exercise intensity (or difficulty or quantity) of the exercise apparatus is increased. In the case of a running treadmill, this difference in intensity could be accomplished by increasing the speed of the treadmill, increasing the angle of inclination of the treadmill, or a combination of the above. If the exercise unit is a cycle, the intensity can be increased by increasing the resistance of pedaling on the cycle machine, or asking the user to increase the speed of pedaling to achieve target heart rate for a particular point in time for the exercise. Contrarily, if the real heart rate is substantially higher than the reference heart rate, the control signal controls the driving part 408, such that the exercise intensity of the exercise apparatus is decreased by the reverse of the above processes.

In case where the user completes the exercise artificially or according to the exercise program (at step 507), the exercise quantity of the user is calculated by the exercise quantity analyzing processor 458 and stored in the exercise record DB 4533 (at step 509). Therefore, the exercise quantity of the user by the exercise apparatuses can be calculated in the units of day, week and month and thus stored in the exercise record DB 4533. Based upon the total exercise quantity of the user for a predetermined unit period, the exercise program processor 457 can formalize another exercise program corresponding to next stages. If the user wishes to know the exercise quantity after completion of the exercise (at step 510), his or her exercise quantity is displayed on the monitor 405 of the exercise apparatus 400 (at step 511) like the display illustrated in FIG. 7.

Figure 7:
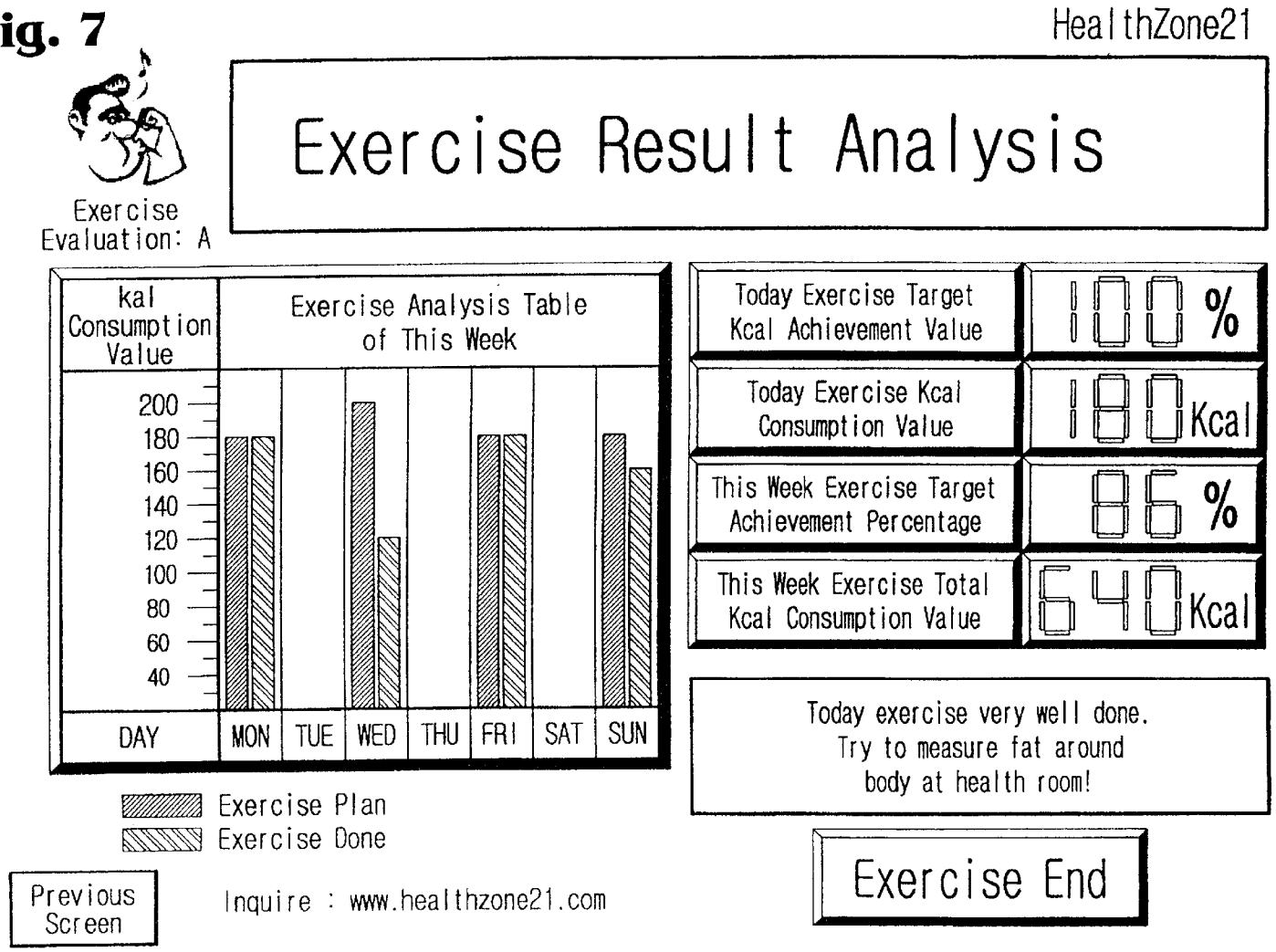
FIG. 7 is a graph for an example of the exercise record calculated from the concentric control system according to the present invention.

FIG. 7 illustrates what is illustrated on monitor 405 of exercise apparatus 400 at the end of an exercise. FIG. 7 illustrates a graph for the exercise record of the user that is processed in the data converting part 461, based upon the data stored in the exercise record DB 4533.

The forgoing embodiments are merely exemplary and are not to be construed as limiting the present invention. The present teachings can be readily applied to other types of devices. The description of the present invention is intended to be illustrative, and not to limit the scope of the claims. Many alternatives, modifications, and variations will be apparent to those skilled in the art.

As clearly described in the above, a concentric control system for exercise apparatuses according to the present invention can receive and store data relevant to the exercise of a user that is inputted to a predetermined exercise apparatus by the user, such that the input data can be used directly in another exercise apparatuses, thereby making the inconvenience caused by the data input considerably removed.

In addition, the concentric control system for exercise apparatuses according to the present invention can control the exercise program adequate to the user, checks in real time the exercise state of the user, adjusts the exercise quantity of the user according to the checked result, such that the user can enjoy the exercise well, without any trouble. As a matter of fact, in case where the exercise quantity of the user is calculated individually for each of the exercise apparatuses used by the user, it is difficult to obtain the total exercise quantity of the user. With the concentric control system for exercise apparatuses according to the present invention, however, the exercise record of the user can be calculated in accurate and easy manners.

What is claimed is:

1. A concentric control system for a plurality of exercise apparatuses that concentrically manages and controls the plurality of exercise apparatuses each having an electronic controller therein, said system comprising:

an exercise program storing unit in which an exercise program is stored in order to designate an adequate quantity of exercise at a time when a user uses a predetermined exercise apparatus;

a comparing unit for receiving the exercise quantity of the user measured from the predetermined exercise apparatus during the exercise and comparing the received data with data on the exercise quantity of the user designated by the exercise program; and a central processing unit for outputting, if the exercise quantity of the user measured during the exercise is substantially smaller than that designated by the exercise program, a control signal such that the electronic controller of the predetermined exercise apparatus operates in order to increase the user's exercise quantity and for outputting, if the exercise quantity measured during the exercise is substantially larger than that designated by the exercise program, another control signal such that the electronic controller of the predetermined exercise apparatus operates in order to decrease the user's exercise quantity.

2. The concentric control system as defined in claim 1, wherein the exercise quantity of the user for the predetermined exercise apparatus is measured in proportional relation with the heart rate of the user.

3. The concentric control system as defined in claim 1, wherein said central processing unit outputs video data, such that the exercise quantity designated by the exercise program and the exercise quantity of the user measured during the exercise simultaneously display on the predetermined exercise apparatus.

4. The concentric control system as defined in claim 1, further comprising an exercise program processor that receives data relevant to exercise inputted by the user and based upon the input data, produces the exercise program adequate to the user.

5. The concentric control system as defined in claim 1, being connected with said plurality of exercise apparatuses through a mutual communication network.

6. The concentric control system as defined in claim 5, wherein the communication network is Internet.

7. The concentric control system as defined in claim 5, wherein the communication network is a local area network (LAN).

8. A concentric control method in which a concentric control system is connected with at least one or more exercise apparatuses each having an electronic controller therein through a mutual communication network for the purpose of controlling the at least one or more exercise apparatuses, said method comprising the steps of:

recognizing information on a user and a predetermined exercise apparatus used by the user when the user uses the predetermined exercise apparatus; and extracting exercise quantity of the user designated from an exercise program previously stored that corresponds with the recognized information on the user and the predetermined exercise apparatus and comparing the extracted exercise quantity of the user with the exercise quantity of the user measured and transmitted from the predetermined exercise apparatus during exercise wherein when the exercise quantity of the user measured during the exercise is substantially smaller than that designated by the exercise program, outputting a control signal such that the electronic controller of the predetermined exercise apparatus operates in order to increase the user's exercise quantity and if the exercise quantity of the user measured during the exercise is substantially larger than that designated by the exercise program, outputting another control signal such that the electronic controller of the predetermined exercise apparatus operates in order to decrease the user's exercise quantity.

9. The concentric control method as defined in claim 8, further comprising the step of inputting data relevant to exercise inputted by the user and based upon the input data, producing an exercise program adequate to the user, said data comprising a user's objective.

10. The concentric control method as defined in claim 8, wherein the communication network is Internet.

11. The concentric control system as defined in claim 8, wherein the communication network is a local area network (LAN).

12. The concentric control system as defined in claim 8, wherein the exercise quantity of the user for the predetermined exercise apparatus is measured in proportional relation with the heart rate of the user.

13. A computerized exercise system providing custom-made exercises for a user, said system comprising:

a control system, comprising:

a central processing unit for controlling the overall operation of said control system;

a first memory comprising information used to register and identify a user;

a second memory comprising custom-made exercises for a variety of exercise equipment for a user;

a third memory comprising an exercise history for a user;

a comparing unit comparing a target heart rate with an in-situ heart rate and adjusting an intensity of an exercise when said actual, in-situ heart rate deviates from said target heart rate;

an exercise apparatus, comprising:

an input part allowing a user to enter a user ID and a password to locate information on said user from said first, said second and said third memories of said control system;

a driving part used to adjust an intensity of an exercise based on deviations of a user's heart rate from a target heart rate;

a measuring part measuring, in situ, a heart rate of a user during an exercise;

a monitor displaying heart rate deviations of said user from a target heart rate for the duration of said exercise; and an internet providing a two-way communication link between said control system and said exercise apparatus.

14. The exercise system of claim 13, said target heart rate being based on information in said first, second and third memories pertaining to said user.

15. The exercise system of claim 14, said information used to register a user comprises user's objectives.

16. The exercise system of claim 14, said information used to register said user comprises a user's height, a user's weight, a user's age, and a user's blood pressure.

17. The exercise system of claim 14, wherein said intensity is adjusted by adjusting an angle of inclination in the case said exercise apparatus is a treadmill and adjusting a force of resistance when said exercise apparatus is a cycle.

18. The exercise system of claim 14, wherein said intensity is adjusted by adjusting a speed at which a user must exercise.

19. The method of claim 8, wherein said increasing and decreasing said exercise quantity during a course of an exercise is achieved by changing the angle of inclination on a treadmill when said user is using a treadmill as an exercise apparatus, changing the amount of resistance to pedal a cycle when a cycle is used as an exercise apparatus.

20. The method of claim 8, wherein said increasing and decreasing said exercise quantity during a course of an exercise to achieve a target heart rate is achieved by changing a speed required by a user to operate said exercise apparatus.

* * * * *